United States Patent [19]

Ekdahl

[11] Patent Number: 5,019,832

[45] Date of Patent: May 28, 1991

[54] NESTED-CONE TRANSFORMER ANTENNA

[75] Inventor: Carl A. Ekdahl, Santa Fe, N. Mex.

[73] Assignee: The United States of America as represented by the Department of Energy, Washington, D.C.

[21] Appl. No.: 423,174

[22] Filed: Oct. 18, 1989

[51] Int. Cl.[5] ..... H01Q 1/36; H01Q 13/04

[52] U.S. Cl. ..... 343/774; 343/776

[58] Field of Search ..... 343/773-775, 343/787, 776, 790, 791, 808, 809, 898, 853, 905, 899, 792, 863

[56] References Cited

U.S. PATENT DOCUMENTS

| | | | |
|---|---|---|---|
| 2,454,766 | 11/1948 | Brillouin | 343/786 |
| 2,920,322 | 1/1960 | Brown, Jr. | 343/776 |
| 3,605,099 | 9/1971 | Griffith | 343/774 |
| 3,919,710 | 11/1975 | Fletcher et al. | 343/846 |
| 3,983,561 | 9/1976 | Biagi | 343/787 |

FOREIGN PATENT DOCUMENTS

| | | | |
|---|---|---|---|
| 446441 | 4/1936 | United Kingdom | 343/899 |
| 685073 | 12/1952 | United Kingdom | 343/774 |
| 858993 | 1/1961 | United Kingdom . | |

*Primary Examiner*—Michael C. Wimer

*Attorney, Agent, or Firm*—Ray G. Wilson; Paul D. Gaetjens; William R. Moser

[57] ABSTRACT

A plurality of conical transmission lines are concentrically nested to form an output antenna for pulsed-power, radio-frequency, and microwave sources. The diverging conical conductors enable a high power input density across a bulk dielectric to be reduced below a breakdown power density at the antenna interface with the transmitting medium. The plurality of cones maintain a spacing between conductors which minimizes the generation of high order modes between the conductors. Further, the power input feeds are isolated at the input while enabling the output electromagnetic waves to add at the transmission interface. Thus, very large power signals from a pulse rf, or microwave source can be radiated.

5 Claims, 3 Drawing Sheets

NESTED-CONE TRANSFORMER ANTENNA

BACKGROUND OF THE INVENTION

This invention relates to antennas for outputting electromagnetic waves and, more particularly, to antennas for outputting high power electromagnetic waves. This invention is the result of a contract with the Department of Energy (Contract No. W-7405-ENG-36).

The limiting factor for many high power applications of pulsed-power, radio-frequency (rf), or microwave sources of electromagnetic energy is electrical breakdown at dielectric interfaces. Breakdown limits the power density which can be transmitted across the interface into the adjacent electromagnetic wave transmitting medium, such as air or vacuum. The maximum power density of electromagnetic fields that can be transmitted scales as the square of the breakdown field. Thus, high power applications require large interface areas for launching electromagnetic waves since the only way to increase the total transmitted power, given a breakdown power density at the launch interface, is to increase the area of the interface.

The breakdown field for a bulk dielectric is significantly greater than the breakdown field at an interface. Thus, a constant-impedance conical transmission line would act to increase the line dimensions at the interface from the dimensions at the input feed-bulk dielectric interface until the anode-cathode spacing is large enough to prevent breakdown at the interface. The spacing at the input feed point needs to be only large enough to prevent breakdown in the bulk dielectric material of the transmission line.

However, establishing the large voltage across a conical transmission line needed for a high power output requires a high power output source. Such sources are difficult to obtain. Further, as the spacing between the two cones forming the conical transmission line increases, higher order modes in the electromagnetic field may be developed which reduce the power output in the desired transmission mode. This is particularly detrimental when short pulses or high frequency rf is transmitted.

These and other problems in the prior art are addressed by the present invention and an improved antenna is provided for transmitting high power electromagnetic waves.

Accordingly, it is an object of the present invention to provide an antenna for transmitting high power electromagnetic waves without developing higher order modes in the waves.

Another object of the present invention is to provide for using a plurality of power generators which add in series to provide the desired output power.

Yet another object of the present invention is to enable a very high power pulse of electromagnetic energy to be generated and launched from an antenna having an air interface.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

SUMMARY OF THE INVENTION

To achieve the foregoing and other objects, and in accordance with the purposes of the present invention, as embodied and broadly described herein, the apparatus of this invention may comprise an antenna formed from a plurality of conical transmission lines arranged in a concentric nested relationship for transmitting a high energy electromagnetic wave. The conical transmission lines form a wave transmission interface which is sized to preclude breakdown in a wave transmission medium at the launch interface. The number of conical transmission lines is selected to accommodate a predetermined power for the electromagnetic wave. In a particular embodiment, for pulse power inputs, parallel feed inputs to the nested conical antennas are fed through toroidal cores of magnetic material, which provide effective inductive isolation for the parallel inputs.

BRIEF DESCRIPTION OF THE DRAWINGS

The accompanying drawings, which are incorporated in and form a part of the specification, illustrate embodiments of the present invention and, together with the description, serve to explain the principles of the invention. In the drawings.

DETAILED DESCRIPTION OF THE INVENTION

Figure 1:
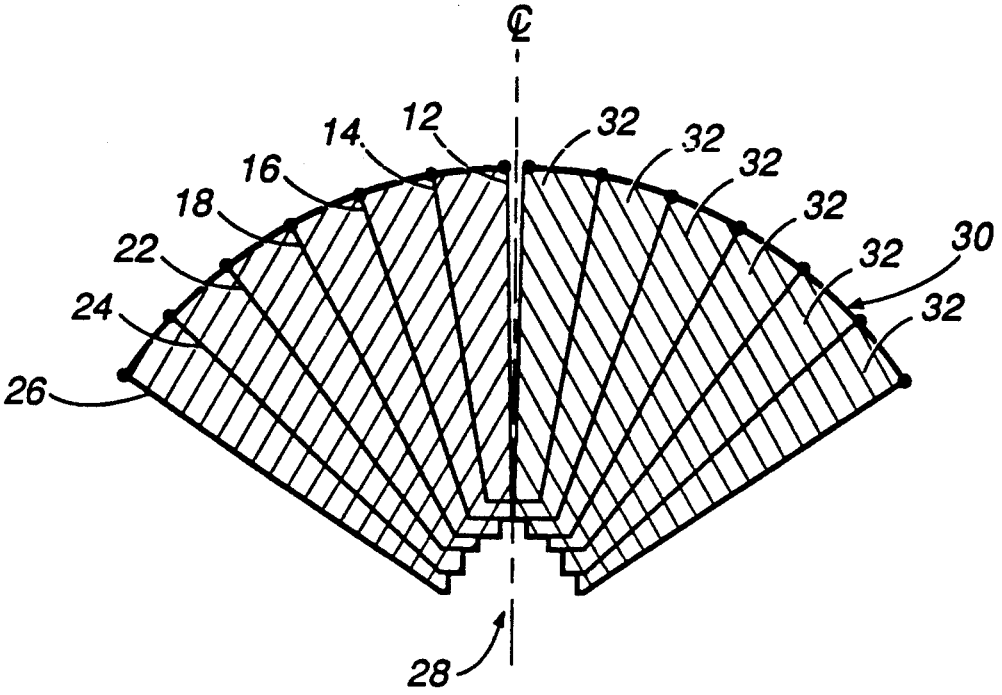
FIG. 1 is a cross-sectional illustration of one embodiment of a nested-cone antenna transformer according to the present invention.

Referring now to FIG. 1, a nested-cone transformer antenna is illustrated in cross section. A plurality of conical conductors 12, 14, 16, 18, 22, 24, and 26 are arranged to form concentric nested transmission lines. Dielectric separators 32 separate the nested transmission line cones so that any breakdown between the cones would be through the bulk of a dielectric 32. Energy feed connections 28 provide for inputting the energy which forms the output electromagnetic wave. The nested cones are each driven by sources operating at voltages below the breakdown strength of the bulk dielectric 32, which insulates the feed points and the conical lines 12, 14, 16, 18, 22, 24, and 26. The nested transmission lines shown in FIG. 1 add the transmission line power outputs at the transmission medium interface 30.

Figure 3:
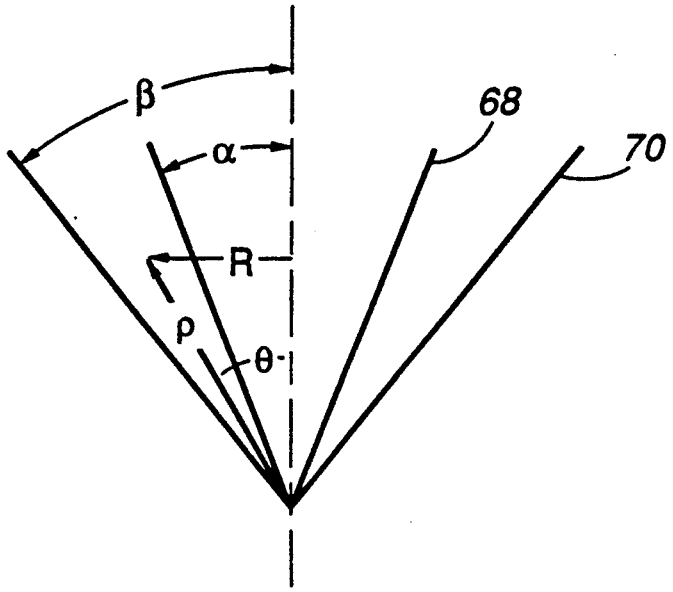
FIG. 3 schematically illustrates functional relationships of components.

FIG. 3 shows the functional features of a pair of nested cones 68 and 70 forming a conical transmission line. This conical line has a constant-impedance for TEM waves given by $$Z = \frac{60}{\sqrt{K}} \ln\left\{ \frac{\tan(\beta/2)}{\tan(\alpha/2)} \right\}, \quad (1)$$

where K is the dielectric constant of the dielectric between cones 68 and 70. The electric and magnetic fields in the line are $$E_\theta = \eta \frac{I}{2\pi R} \quad (2)$$

and $$B_\phi = \mu \frac{I}{2\pi R} \quad (3)$$

where I is the current, $\eta = \sqrt{\epsilon/\mu}$, and $R = \rho \sin \theta$. Equation 2 shows that the field strength falls off as $1/\rho$ as the pulse propagates up the line to the launch interface, e.g., interface 30 (FIG. 1), where the waves propagating from each conical transmission line add to form a spherical wave.

Thus, by making the conical transmission lines 68, 70 long enough, the field can be reduced from the breakdown field in the bulk material to less than the breakdown field for the interface with the wave transmission medium. By maintaining the angles $\alpha$ and $\beta$ and within selected limits, i.e., maintaining a small spacing between cones, short pulses cannot generate higher order modes which degrade the fundamental output wave. The total energy in the outgoing wave is now limited only by the breakdown field at the interface and the interface area, so that by combining the pulses from many lines at the interface the output wave has the maximum possible energy content.

Figure 2:
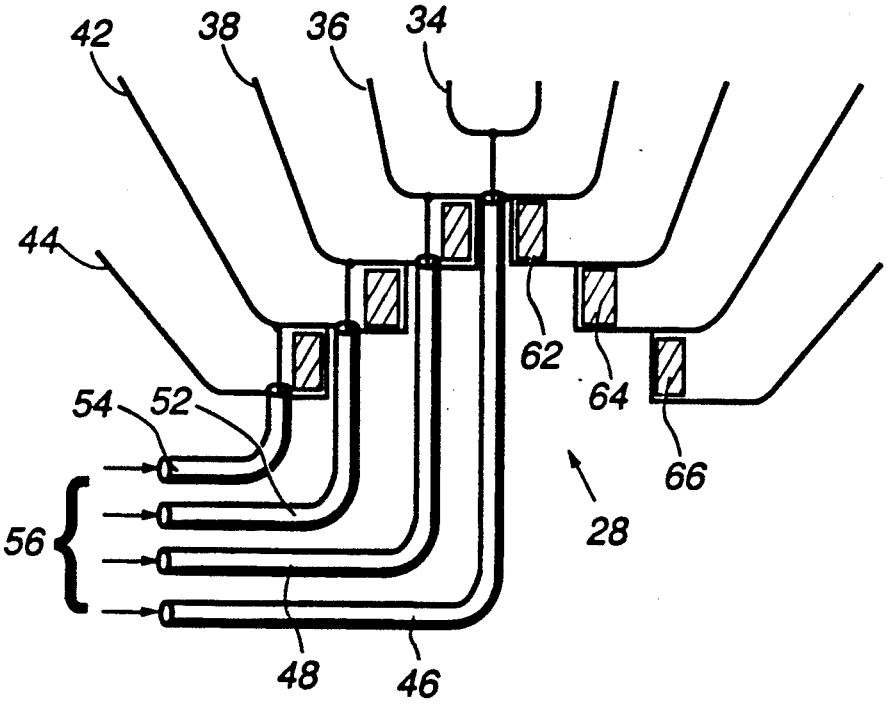
FIG. 2 is a cross-sectional illustration of the input power configuration according to one embodiment of the present invention.

Referring now to FIG. 2, an arrangement of energy feed connections 28 is shown for isolating from each other cones 34, 36, 38 42, and 44, which form the nested-cone antenna. The input leads 56 through coaxial cables 46, 48, 52, and 54 cannot be isolated by simply breaking the connection between the cable shields. The dielectric interface would then have dimensions too small to prevent breakdown.

According to the present invention, inductive isolation may be provided to isolate the input feeds 56. Toroidal cores 62, 64, and 66 are formed of a suitable magnetic material so that the resulting rf or pulse impedance is great enough to provide the isolation. Thus, although each feed has a DC short-circuit path to ground, the inductance of this path is high because of the magnetic material. Ferrite isolators or other suitable magnetic materials may be used for pulse power, rf, and microwave application. However, for rf or microwave application, the magnetic material could be eliminated by locating the feed point ¼ wavelength from the short circuited end of the conical line.

By electrically isolating the nested conical transmission lines, the voltages applied through input feeds 56 are added across the conical conductors. Input feeds 56 may be connected to separate power supplies or may be connected in parallel to a single supply. Thus, a transformer-like action is obtained where the effective output voltage is greater than any single input voltage. For pulsed application, the high-voltage (V) applied to each of the feed lines 56 is limited by the saturation magnetic field ($B_s$) in a core, by the cross-sectional area (A) of the core, and by the pulse length ($\Delta t$). The total flux swing is then limited by core magnetic saturation as determined by the relationship $$V\Delta t = B_2 A \quad (4)$$

An appropriate figure of merit to characterize isolator materials is derived from the material saturation magnetic field and the minimum pulsewidth to saturate the material skin depth. Using Equation 4, the figure of merit is also the maximum voltage per unit area of material. Table A depicts the saturation field and minimum pulsewidth for representative materials, yielding the figure of merit shown in the last column of the Table.

TABLE A

| Material | $B_s$ (T) | $\Delta t_{min}$ (ns) | $V_{max}/A$ ($V/m^2$) |
|---|---|---|---|
| Metglas (1-mil) (Allied 2605 SC) | 1.6 | 50 | $3.2 \times 10^7$ |
| Ferrite (TDK PE-14) | 0.4 | 10 | $4 \times 10^7$ |
| Ferrite (TDK PE-1) | 0.5 | 10 | $5 \times 10^7$ |
| Silicon Steel (2-mil) | 1.4 | 500 | $2.8 \times 10^6$ |

To obtain a spherical wave when the fields are added at the transmission medium interface, input leads 56 are driven with equal currents. Then, the outer conductor of one line, e.g., conductor 36 of transmission line 34, 36, forms the inner conductor of the adjacent transmission line, e.g., line 36, 38, wherein the electromagnetic field at the outer conductor of one line will be equal to the field at the inner conductor of the adjacent line. Alternatively, if a nonspherical wavefront is desired, e.g., for antenna directivity, unequal drive currents can be used. Further, although FIG. 1 shows conical elements 12, 14, 16, 18, 22, 24, and 26 having the same length, the length of the conical elements forming the conical transmission lines can be varied to tailor the output wave shape.

Figure 4:
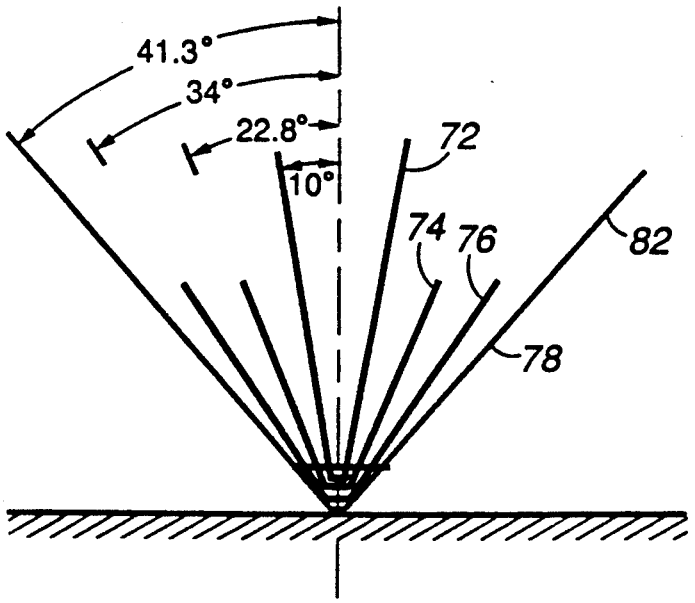
FIG. 4 illustrates a working model of the present invention.

In order to determine if nested cones connected by inductively isolated cables would produce a spherical wave from the outputs adding at the top of the conical lines, a nested-cone transformer antenna was constructed as shown in FIG. 4. Testing to the breakdown limits of the dielectric interfaces is not required to prove the design concept so that air was used as the dielectric between the conical surfaces. For test purposes, the feed section and first meter of the conductive cones 72, 74, 76, 78 were fabricated from sheet metal and aluminum plates. Chicken wire was then used as the conductor to the top of the nested cones at 4.86 m. Finally, from the top of the nested cones to the height of 7.15 m, wires spaced 0.9 m apart in azimuth were used to form an extension of cones 72, 82 for free-field measurements.

Figure 5:
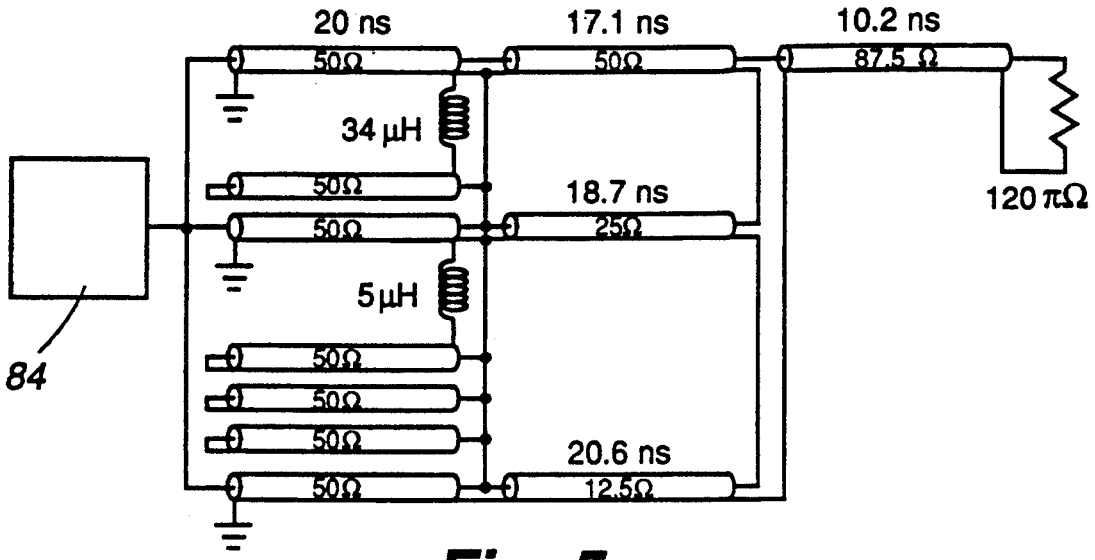
FIG. 5 is an equivalent circuit of the antenna shown in FIG. 4.

The equivalent circuit for the model shown in FIG. 4 is schematically shown in FIG. 5. A single pulser 84 was used to drive all of the conical transmission lines so that the pulse applications would be synchronized. A Maxwell MLI 40230 trigger generator was modified to produce a fast rise time pulse by the addition of peaking gaps after the main output spark-gap switches. The fast rise time was needed to obtain field measurements before reflections arrived from transmission line discontinuities and the surrounding structure. The input feed lines were balanced to provide equal currents to the conical transmission lines. The isolation inductors (see, e.g., toroidal cores 62, 64, 66 in FIG. 2) were TDK PE-1 ferrite toroids giving 34 $\mu$H inductance between the inner 72 and middle cones 74 and a 5 $\mu$H inductance between the outer 82 and middle 76 cones.

The experimental results confirmed that the nested cone transformer antenna according to the present invention performed in the predicted manner. The electric/magnetic field ratio, $E/B = \eta/\mu$, was within the 5-10% experimental uncertainty of theoretical values. There were no anomalous outputs from the test field probes which would indicate any failure of the input isolation by the magnetic cores. Further, the variation of the field with radius R was substantially the (1/R) theoretical variation.

Figure 6:
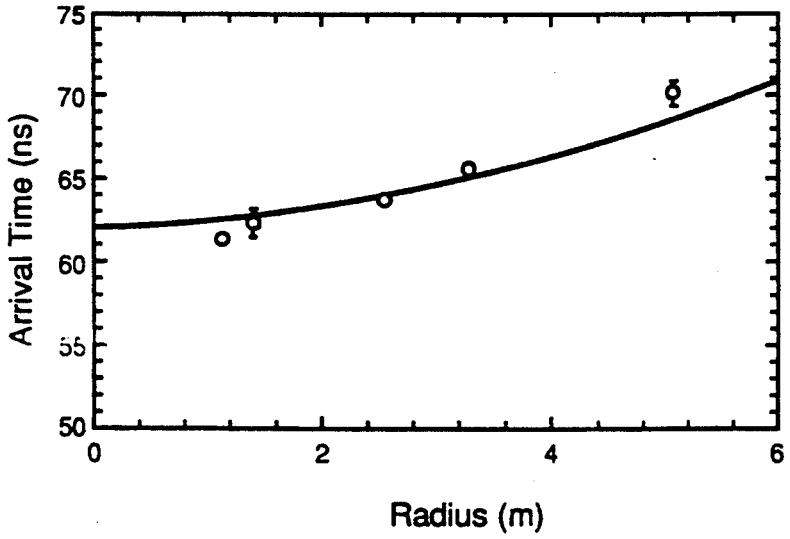
FIG. 6 graphically depicts the output wave from the antenna shown in FIG. 4.

FIG. 6 shows the variation in field arrival time at a plane above the antenna as a function of the radius. The predicted arrival time is shown by the solid line for a spherical wavefront, along with the experimental data points. The deviations of the measured arrival times from sphericity are within the estimated uncertainty of the measurement, considering the rise times and noise on the triggering signals.

Thus, the experimental antenna fabricated according to the present invention performed as predicted. The individual pulses were fed to the conical transmission lines, inductively isolated from each other, and the resulting electromagnetic fields within each conical transmission line added at the top of the transmission lines to form a near-spherical wave. The design is expected to provide the predicted performance up to the breakdown limits of the transmission medium at the antenna interface.

The foregoing description of the preferred embodiment of the invention has been presented for purposes of illustration and description. It is not intended to be exhaustive or to limit the invention to the precise form disclosed, and obviously many modifications and variations are possible in light of the above teaching. The embodiment was chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. An antenna for radiating an electromagnetic wave into a wave transmission medium, comprising:

a plurality of nested conical transmission line conductors defining an outer cone element, an inner cone element, and a plurality of intermediate cone elements therebetween, each said cone element diverging at a predetermined angle and defining a first end for inputting rf energy and a second end for radiating said rf energy;

a plurality of rf coaxial cables for inputting said rf energy, each said cable having a shield conductor connected to a first said cone element and a center conductor connected to a second said cone element adjacent and interior of said first cone element, said outer cone element being connected only to a shield conductor, said inner cone element being connected only to a center conductor, and each said intermediate cone element having a shield conductor connection from one said cable and a center conductor connection from another said cable;

a dielectric medium separating said cone elements from one another; and signal isolation means connected for electrically isolating said shield conductor connection from said center conductor connection on each said intermediate element wherein said rf energy serially adds across said cone elements.

2. An antenna according to claim 1, wherein said signal isolation means includes torodial cores of a magnetic material spaced between said shield conductor connection and said center conductor connection for inductive isolation therebetween.

3. An antenna according to claim 1, wherein said predetermined angle for each said cone element is selected to maintain a spacing with adjacent ones of said cone elements effective to preclude wave modes in said spacing higher than a fundamental mode from said input rf energy.

4. An antenna according to claim 2, wherein said predetermined angle for each said cone element is selected to maintain a spacing with adjacent ones of said cone elements effective to preclude wave modes in said spacing higher than a fundamental mode from said input rf energy.

5. An antenna according to claim 3, wherein said spacing is further selected to radially space said first end from adjacent ones of said first ends a distance effective to establish an electromagnetic field gradient at a breakdown gradient in said dielectric medium with a predetermined maximum input rf energy and each said second end is radially spaced from adjacent ones of said second ends to establish an electromagnetic field gradient less than the breakdown gradient in said wave transmission medium while forming a composite radiated electromagnetic wave with electromagnetic fields radiated from said adjacent ones of said second ends.

* * * * *